US011103981B2

(12) United States Patent
Hargis et al.

(10) Patent No.: US 11,103,981 B2
(45) Date of Patent: Aug. 31, 2021

(54) ANGLED IMPACT WRENCH

(71) Applicant: Klein Tools, Inc., Lincolnshire, IL (US)

(72) Inventors: Scott M. Hargis, North Brook, IL (US); John H. Kargenian, Prospect Heights, IL (US)

(73) Assignee: Klein Tools, Inc, Lincolnshire, IL (US)

( * ) Notice: Subject to any disclaimer, the term of this patent is extended or adjusted under 35 U.S.C. 154(b) by 243 days.

(21) Appl. No.: 16/454,228

(22) Filed: Jun. 27, 2019

(65) Prior Publication Data

US 2020/0406434 A1 Dec. 31, 2020

(51) Int. Cl.
*B25B 21/02* (2006.01)

(52) U.S. Cl.
CPC ..... *B25B 21/023* (2013.01); *B25B 21/026* (2013.01)

(58) Field of Classification Search
CPC ..... B25B 21/023; B25B 21/026; B25B 21/02; B25B 17/00; B25B 13/06; B25B 13/463; B25B 13/481
USPC ..... 81/464
See application file for complete search history.

(56) References Cited

U.S. PATENT DOCUMENTS

2012/0118596 A1* 5/2012 Scott ..... B25B 21/026 173/98
2014/0157961 A1* 6/2014 Chen ..... B25B 21/004 81/464

* cited by examiner

*Primary Examiner* — David B. Thomas
*Assistant Examiner* — Thomas Raymond Rodgers

(57) ABSTRACT

An angled impact wrench includes a housing mounting a motor having an output shaft rotatable about a first axis, and an impact drive unit mounted in the housing for rotation about a second axis that is nonparallel to the first axis. The impact drive unit is configured to repeatedly cycle between an energy storing and energy release conditions in response to a drive torque supplied by the motor. The impact drive unit has a through passage extending along the second axis to allow a workpiece to extend completely through the impact wrench while the drive unit torques a threaded fastener onto the workpiece.

18 Claims, 8 Drawing Sheets

ANGLED IMPACT WRENCH

CROSS-REFERENCE TO RELATED APPLICATIONS

None

BACKGROUND OF THE DISCLOSURE

The present disclosure relates impact wrenches that utilize a motor to power an impact device that can forcefully rotate threaded fasteners, and more particularly, to angled impact wrenches that drive the fasteners about a drive axis that is non-parallel to an rotational axis of an drive shaft of the motor, with the drive axis typically being at a right-angle to the rotational axis of the drive shaft. While such devices are known and suitable for many purposes, there are still limitations to their use. Accordingly, there is a continuing desire to improve such devices, including by increasing their usefulness to a user by expanding the devices ability to accommodate a variety of uses.

BRIEF SUMMARY OF THE DISCLOSURE

In accordance with one feature of this disclosure, an angled impact wrench is capable of driving a fastener onto a workpiece that extends completely through a portion of the impact wrench. The impact wrench includes a housing; a motor mounted in the housing, the motor having an output shaft rotatable about a first axis; and an impact drive unit mounted in the housing for rotation about a second axis that is nonparallel to the first axis. The impact drive unit has an energy storing condition and an energy release condition, and is configured to repeatedly cycle between the energy storing condition and the energy release condition in response to a drive torque supplied by the motor via the output shaft. The impact drive unit having a through passage extending along the second axis to allow a workpiece to extend completely through the impact wrench.

In one feature, the angled impact wrench further includes a gear train mounted in the housing to transfer a drive torque from the output shaft of the motor to the impact drive unit. In a further feature, the gear train includes a first bevel gear mounted in the housing for rotation about the first axis and operably connected to the output shaft to be rotationally driven by the motor; and a second bevel gear mounted in the housing for rotation about the second axis. The second bevel gear surrounds a portion of the impact drive unit and is meshed with the first bevel gear to rotationally driven by the motor. In yet a further feature, the gear train further includes a planetary gear train including a sun gear driven by the output shaft of the motor and a planet gear carrier driving the first bevel gear. The sun gear and the planet gear carrier are mounted for rotation about the first axis.

According to one feature, the impact drive unit includes a rotatable hammer and a rotatable anvil mounted in the housing for rotation about the second axis. The rotatable hammer impacts the rotatable anvil with the impact drive unit in the energy release condition to create a drive torque at an output of the impact drive unit. In a further feature, the rotatable hammer has a through bore extending along the second axis, and the rotatable anvil has a through bore extending along the second axis. The through bores defining a portion of the through passage.

As one feature, the impact drive unit includes a spring mounted to store energy with the impact drive unit in the energy storing condition and to release energy with the impact drive unit in the energy release condition. In a further feature, the impact drive unit further includes mating ball ramps configured to generate an axial compression force with the impact drive unit in the energy storing condition.

In accordance with one feature of this disclosure, the impact drive unit includes an input shaft, a rotatable hammer, a compression spring, and a rotatable anvil. The input shaft is mounted in the housing for rotation about the second axis and operably connected to the output shaft to be rotationally driven about the second axis by the motor. The input shaft has a through bore centered on the second axis to allow a workpiece to extend completely through the impact wrench along the second axis, and a cam feature on an outer surface of the input shaft. The rotatable hammer is mounted in the housing for rotation about the second axis and has a through bore centered on the second axis and surrounding a portion of the input shaft, a cam feature on an inner surface of the through bore of the rotatable hammer and operably connected to the cam feature on the input shaft to translate the rotatable hammer along the second axis relative to the input shaft over a limited linear distance in response to rotation of the input shaft with the impact drive unit in the energy storing condition, and at least one impact surface. The compression spring is sandwiched between a surface on the input shaft and a surface on the rotatable hammer to store energy as the rotatable hammer translates over the limited linear distance with the impact drive unit in the energy storing condition and to transfer energy back to the rotatable hammer with the impact drive unit in the energy release condition. The rotatable anvil is mounted in the housing for rotation about the second axis and has a through bore centered on the second axis to allow a work piece to extend completely through the impact wrench along the second axis, and at least one impact surface engageable with the at least one impact surface of the rotatable hammer to receive an impact force from the rotatable hammer with the impact device in the energy release condition. The through bore of the rotatable anvil includes a drive feature to transfer a drive torque to a driven component received in the through bore of the rotatable anvil.

In one feature, the angled impact further includes a gear train operably connecting the output shaft of the motor to the input shaft of the impact drive unit. In a further feature, the gear train includes a first bevel gear mounted in the housing for rotation about the first axis and operably connected to the output shaft to be rotationally driven by the motor; and a second bevel gear mounted in the housing for rotation about the second axis. The second bevel gear surrounds a portion of the input shaft and is meshed with the first bevel gear to rotationally driven by the motor. In yet a further feature, the gear train further includes a planetary gear train including a sun gear driven by the output shaft of the motor and a planet gear carrier driving the first bevel gear. The sun gear and the planet gear carrier are mounted for rotation about the first axis.

According to one feature, the at least one impact surface of the rotatable hammer includes a first pair of circumferentially spaced surfaces, and the at least one impact surface of the rotatable hammer includes a second pair of circumferentially spaced surfaces.

As one feature, the cam feature on the input shaft is formed in a radially outwardly facing cylindrical surface of the input shaft; and the cam feature on the rotatable anvil is formed in a radially inwardly facing cylindrical surface of the anvil. In a further feature, the cam features are ball ramps connected by at least one ball bearing riding in the ball ramps.

In one feature, the through bore of the rotatable hammer includes a radially inwardly facing cylindrical surface that is sized for guided translation over a radially outwardly facing cylindrical surface on the input shaft.

According to one feature, the through bore in the input shaft includes a radially inwardly facing cylindrical bearing surface that receives a radially outwardly facing cylindrical journal surface on the rotatable anvil to form a rotatable bearing support for the input shaft.

In one feature, the angled impact wrench further includes a driven component in the form of a fastener drive socket engaged in the through bore of the rotatable anvil.

As one feature, the motor is an electric motor. In a further feature, the angled impact wrench of further includes a battery releasably connected to the housing and operably connected the electric motor to supply electric power to the electric motor.

It should be understood that the inventive concepts disclosed herein do not require each of the features discussed above, may include any combination of the features discussed, and may include features not specifically discussed above.

DETAILED DESCRIPTION OF PREFERRED EMBODIMENTS

Figure 1:
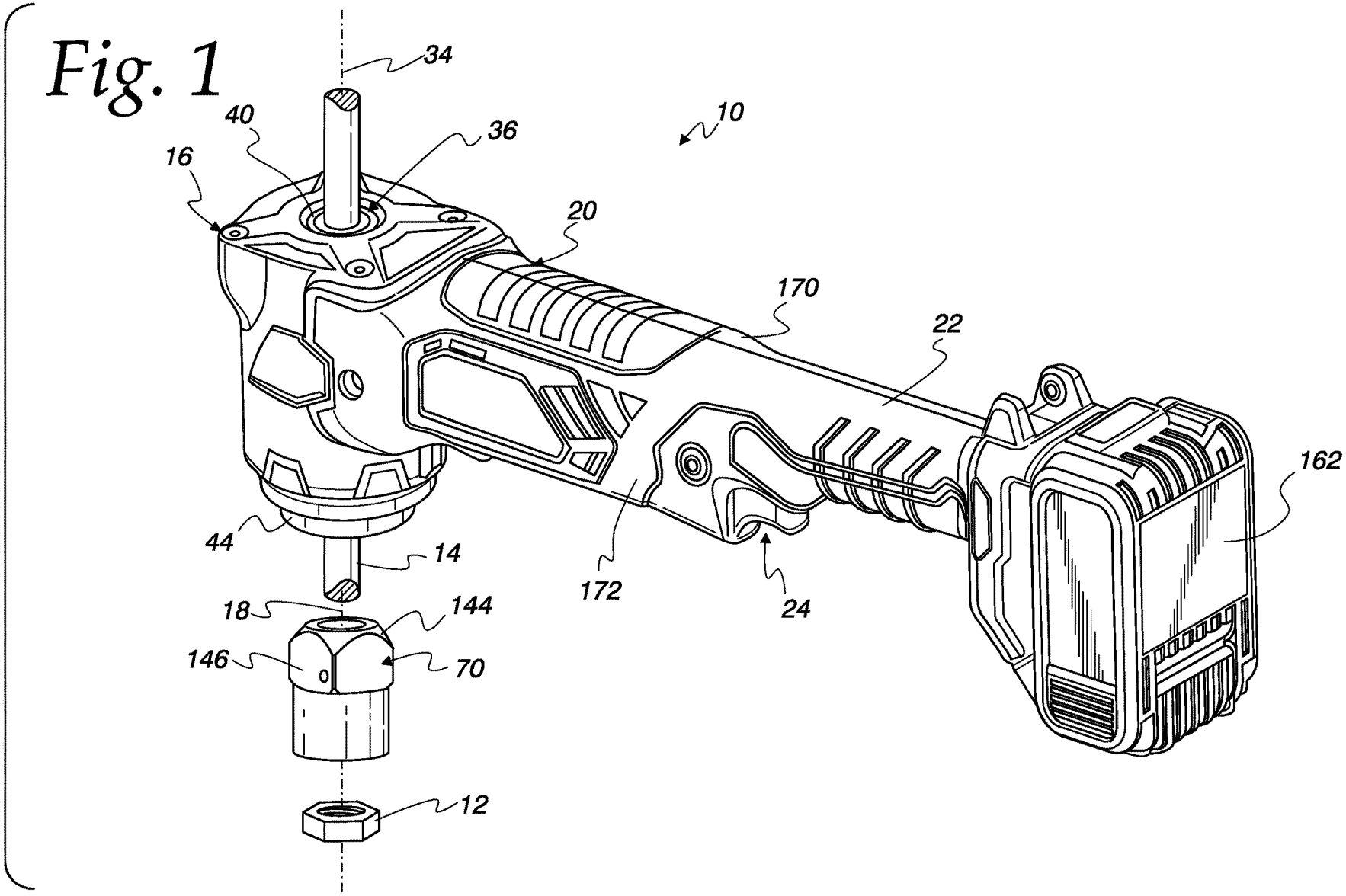
FIG. 1 is a perspective view from above and to the left and rear of an angled impact wrench according to this disclosure, together with a threaded rod and two examples of items that can be driven with the angled impact wrench while threaded rod extends through the angled impact wrench.
Figure 2:
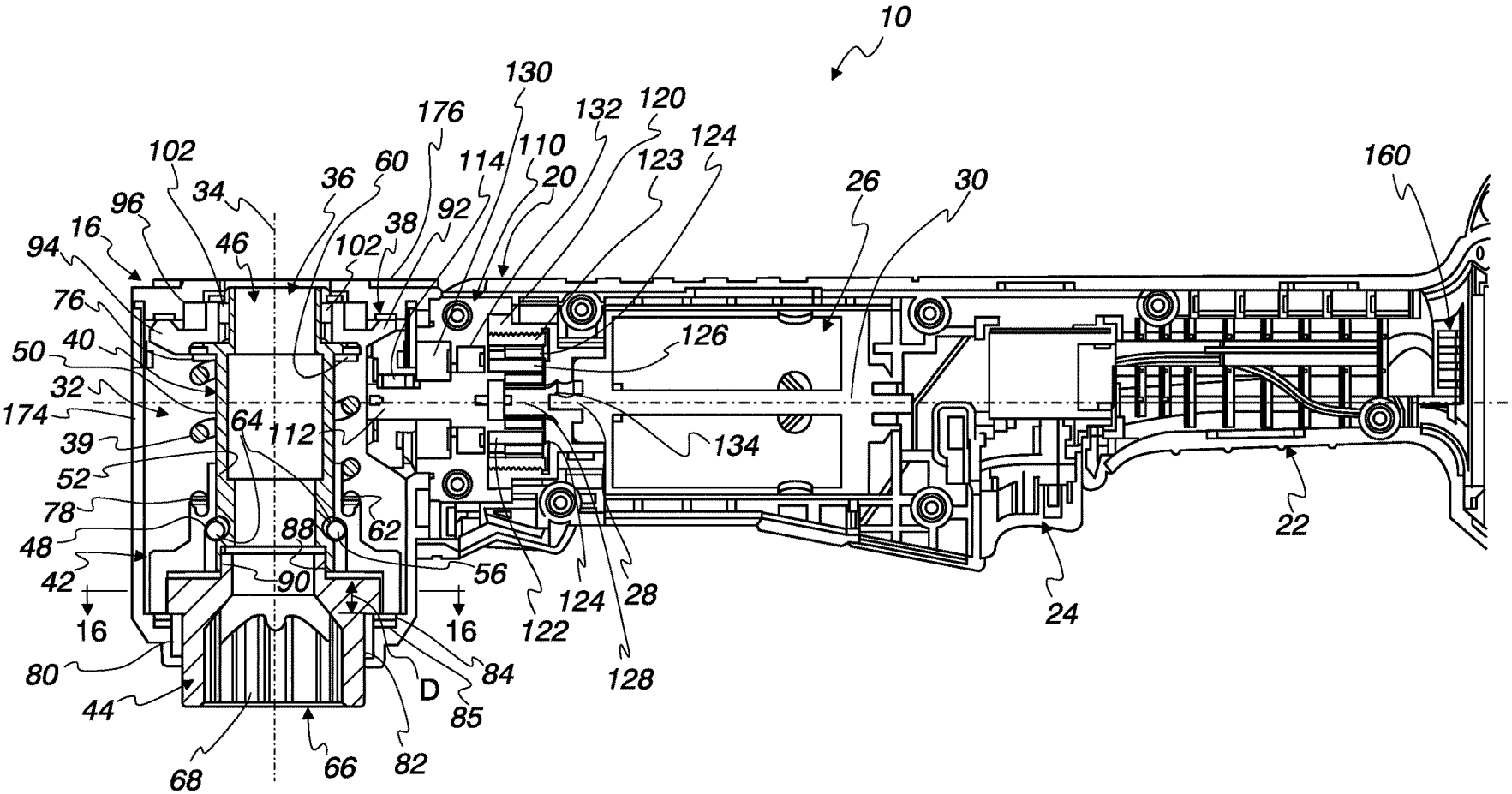
FIG. 2 is a partial, longitudinal cross-section of the angled impact wrench of FIG. 1.

As best seen in FIG. 1, An angled impact wrench 10 is provided for driving a threaded fastener 12 onto a workpiece 14 that extends completely through a drive portion 16 of the impact wrench 10. For purposes of illustration in FIG. 1, the threaded fastener 12 is shown in the form of a hex nut 12 and the workpiece 14 is shown in the form of a threaded cylindrical rod 14 (threads not shown) extending along a rod axis 18. As best seen in FIG. 2, in the illustrated embodiment, the impact wrench 10 includes: a housing 20 having a user grip 22; a variable speed trigger switch 24 adjacent the grip 22 for actuation by a user's index finger; an electric motor 26 mounted in the housing 20 and having an output shaft 28 rotatable about a motor axis 30; an impact drive unit 32 mounted in the housing 20 for rotation about an drive axis 34 and having a through passage 36 extending along the drive axis 34 to allow a workpiece, such as the workpiece 14, to extend through the drive portion 16; and a gear train 38 operably connecting the output shaft 28 to the impact drive unit 32 to drive the impact drive unit about the drive axis 34. In the illustrated embodiment, the rod axis 18 is aligned with the drive axis 34, and the axes 30 and 34 are perpendicular and intersecting, which is preferred. However, it should be understood that other nonparallel orientations of the axes 30 and 34 relative to each other may be desirable depending upon the specific requirements for each intended use of the impact wrench 10, and that in some applications it may be desirable for the axes 30 and 34 to not intersect.

The impact drive unit 32 has an energy storing condition wherein energy is stored in a helical compression spring 39 of the impact drive unit 32 as elastic or spring potential energy, and an energy release condition wherein the potential energy stored in the spring 39 is converted to kinetic energy for driving a fastener 12. The impact drive unit 32 is configured to repeatedly cycle between the energy storing condition and the energy release condition in response to a drive torque supplied by the motor 26 via the output shaft 28 and the gear train 38.

Figure 5:
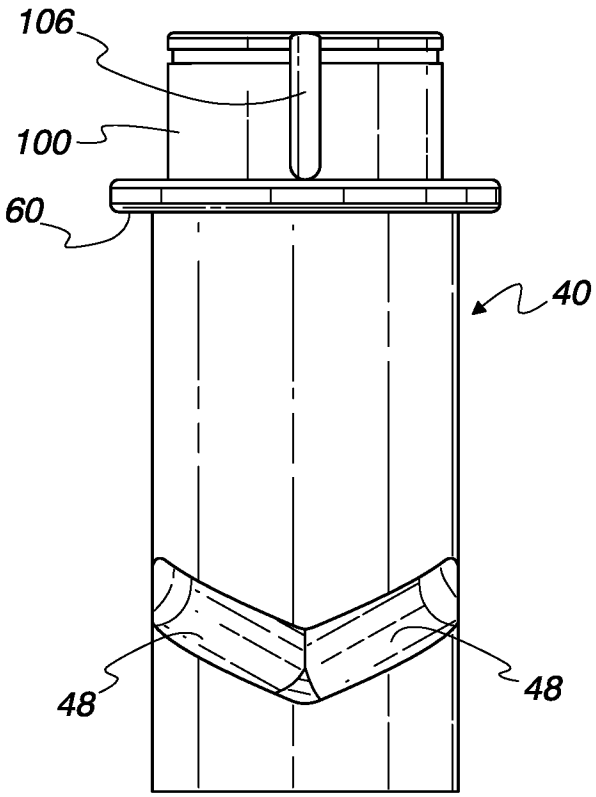
FIG. 5 is a side elevation view taken of the input shaft component of FIG. 4
Figure 4:
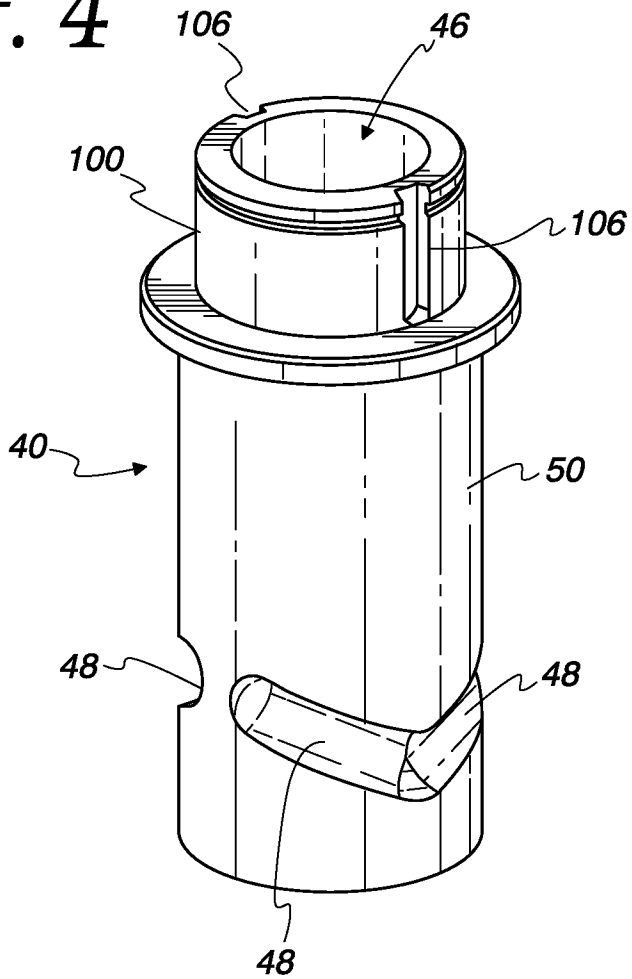
FIG. 4 is an enlarged perspective view from above of an input shaft component of the angled impact wrench of FIG. 1.
Figure 8:
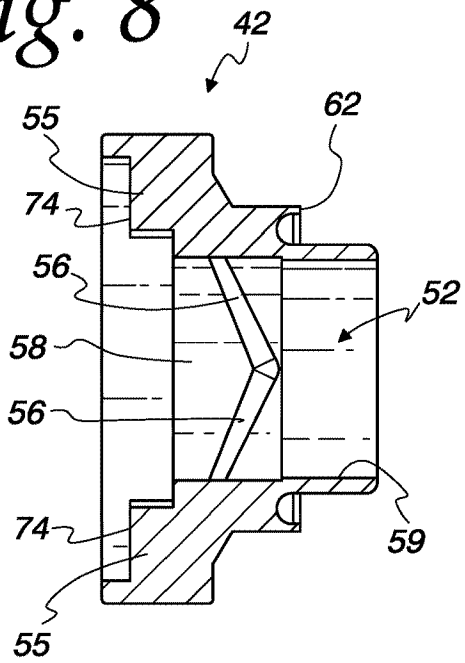
FIG. 8 is a section view taken from line 8-8 in FIG. 6
Figure 7:
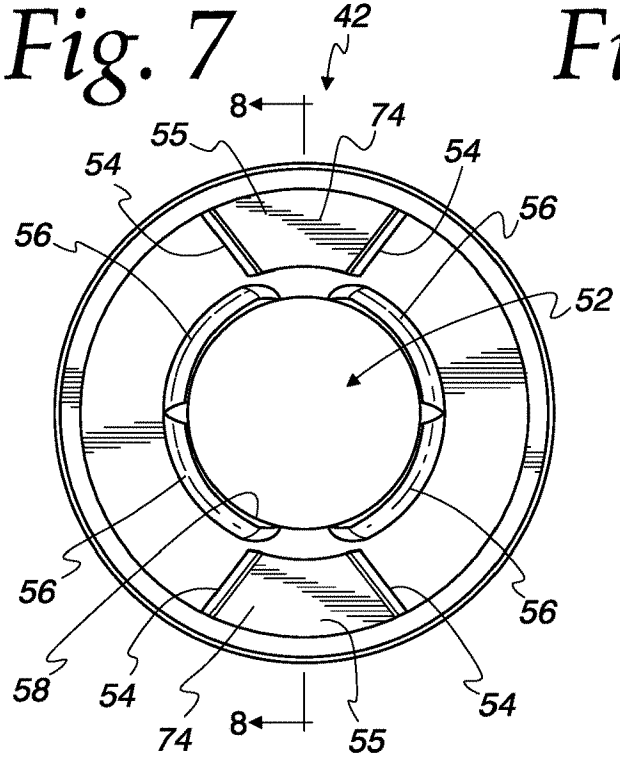
FIG. 7 is a bottom view of the rotatable hammer component of FIG. 6.
Figure 6:
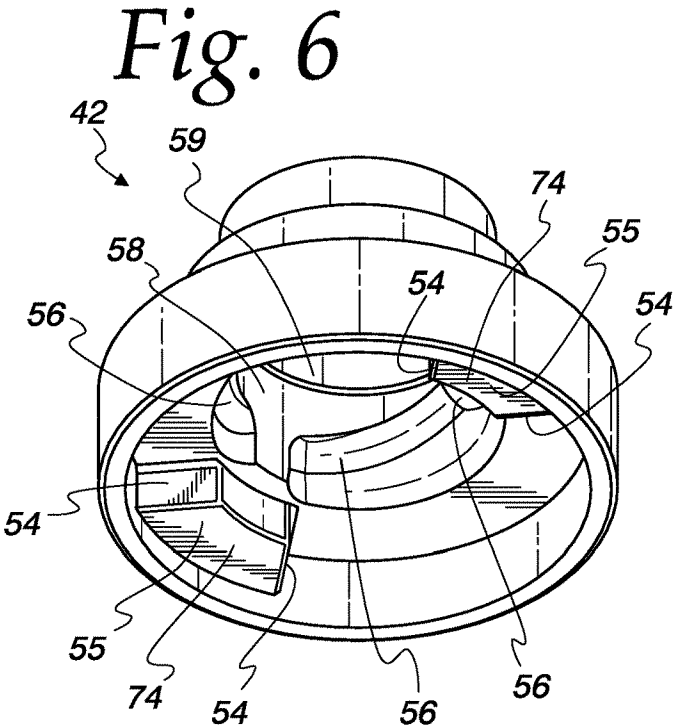
FIG. 6 is an enlarged perspective view from below of a rotatable hammer component of the impact wrench of FIG. 1
Figure 11:
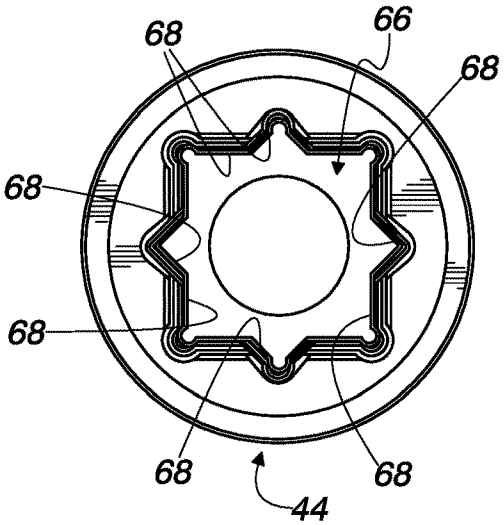
FIG. 11 is a bottom view of the rotatable anvil component of FIG. 9.
Figure 10:
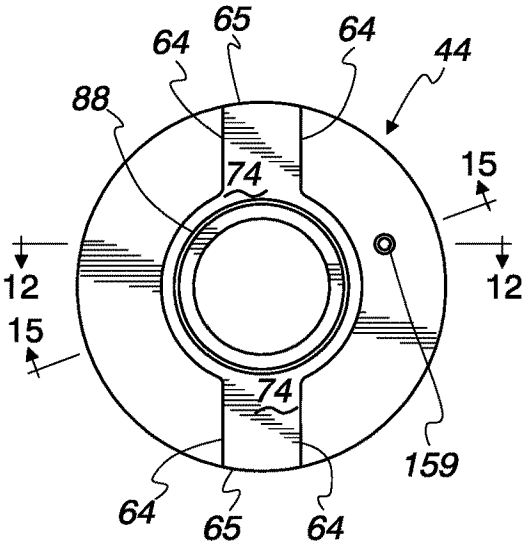
FIG. 10 is a top view of the components of FIG. 9.
Figure 9:
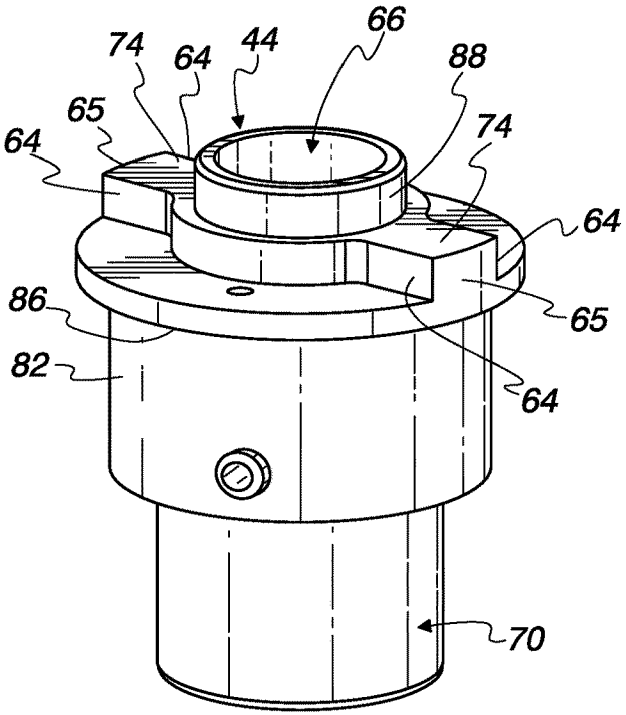
FIG. 9 is an enlarged perspective view of a rotatable anvil component and a removable drive socket of the impact wrench of FIG. 1.

The impact drive unit 32 includes an input shaft 40, a rotatable hammer 42, and a rotatable anvil 44, all of which are mounted in the housing for rotation about the drive axis 34. As best seen in FIGS. 4 and 5, the input shaft 40 has a through bore 46 centered on the axis 34, and four cam features 48 formed on a radially outwardly facing cylindrical surface 50 of the input shaft 40. As best seen in FIGS. 6-8, the rotatable hammer 42 has a through bore 52 centered on the axis 34, two pairs of circumferentially spaced impact surfaces 54 formed on a pair of circumferentially spaced impact lugs 55, and four cam feature 56 formed on a radially inwardly facing cylindrical surface 58 of the through bore 52. The through bore 52 further includes a radially inwardly facing cylindrical surface 59 sized for guided translation and rotation over the cylindrical surface 50 of the input shaft 40. As best seen in FIG. 2, the spring 39 is sandwiched between an annular surface 60 on the input shaft 40 and an annular surface 62 on the rotatable hammer 42. As best seen in FIGS. 9, 10, 13, and 16, the rotatable anvil 44 has two pairs of circumferentially spaced impact surfaces 64 formed on a pair of circumferentially spaced impact lugs 65, and a through bore 66 centered on the drive axis 34. The through bore 66 includes drive features 68 configured to transfer a drive torque to a driven component, such as a fastener 12 or a fastener drive socket 70, received in the through bore 66. In the illustrated embodiment, the drive features 68 define a double square drive socket capable of engaging two different sizes of square drives. Together, the through bores 46 and 66 define the through passage 36.

In the illustrated and preferred embodiment, the cam features 48 and 56 are shown in the form of ball ramps 48 and 56 that are operably connected by spherical ball bearings 64, shown in FIG. 2, to translate the rotatable hammer 42 along the axis 34 relative to the input shaft 40 over a limited distance D to compress the spring 39 in response to rotation of the input shaft 40 with the impact drive unit 32 in the energy storing condition and then to allow the spring 39 to force the rotatable hammer 42 to translate back along the axis 34 over the distance D while rotating about the drive axis 34 relative to the rotatable anvil 44 with the impact drive unit 32 in the energy storage condition. In this regard, the impact surfaces 54 on the rotatable hammer 42 abut the impact surfaces 64 of the anvil to restrict rotation of hammer 43 about the drive axis 34 with the impact drive unit 32 in the energy storing condition. The surfaces 54 and 64 slide against each other as the rotatable hammer 42 translates along the drive axis 34 over the distance D, compressing the spring 39 until the surfaces 54 clear the axial height of the surfaces 64. At this point, the rotatable hammer 42 rotates about the drive axis 34 relative to the rotatable anvil 44, with respective face surfaces 72 and 74 on the lugs 55 and 65 slidably engaged against each other to maintain the spring 39 in its compressed condition. When the circumferential widths of the lugs 55 clear the circumferential widths of the lugs 65, the impact drive unit 32 switches to the energy release condition wherein the spring 39 and the interaction of the cam features 48 and 56 force the rotatable hammer 42 to rotate about and translate along the drive axis 25 toward the rotatable anvil 44 until the impact surfaces 54 engage the impact surfaces 64 to transmit a circumferentially directed impact force and rotational energy from the rotatable hammer 42 to the rotatable anvil 44. In turn, the anvil 44 transmits the impact force and rotational energy to a driven component, such as a fastener 12 or drive socket 70, received in the through bore 66. While the construction of the impact drive unit 32 to provide a through passage 36 as disclosed herein is an inventive concept of this disclosure, it should be understood that the operation of impact devices using ball ramps, an energy storing spring, a rotatable hammer, and a rotatable anvil such described in this paragraph is known and will be easily understood by one skilled in the art.

The components 40, 42, 44 and 64 of the impact drive unit 33 can be made from any suitable material, and in the illustrated embodiment are made from a suitable hardened steel material.

Annular washers 76 and 78 are provided between the spring 39 and the annular surfaces 60 and 62 to reduce rotational friction generated between the spring 39 and the input shaft 40 and rotatable hammer 42. A radial journal bearing or bushing 80 is provided between the housing 20 and a cylindrical outer surface 82 on the rotatable anvil 44 and an annular busing 84 and washer 85 are provided between the housing 20 and an annular surface 86 on the rotatable anvil 44 to rotatably mount the anvil 44 in the housing 20. The rotatable anvil 44 further includes an outwardly facing cylindrical surface 88 that is received in an inwardly facing cylindrical surface 90 formed in the bore 46 to provide a rotational mount for one end of the input shaft 40.

Figure 3:
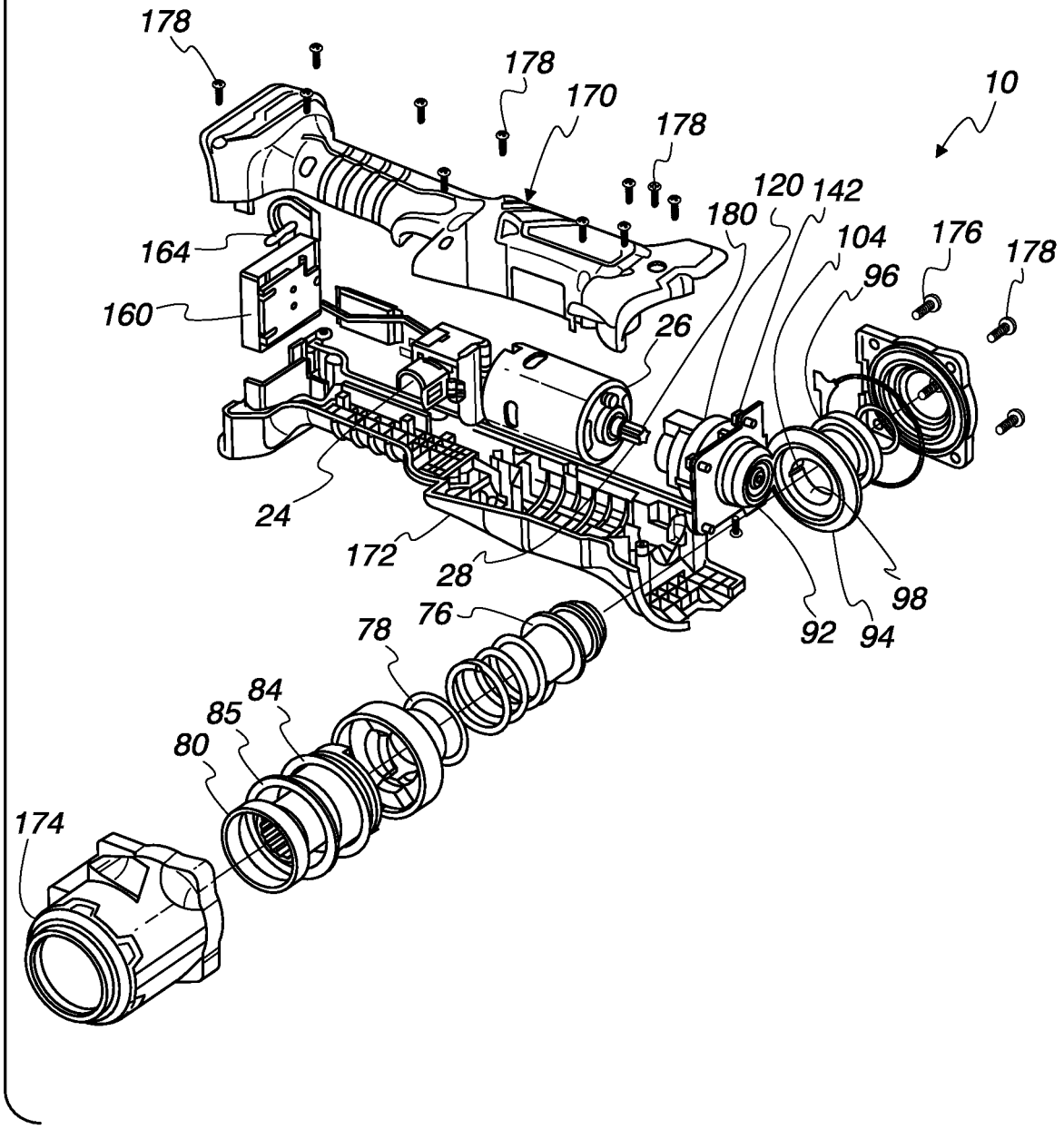
FIG. 3 is an exploded view of the angled impact wrench of FIG. 1.

The gear train 38 includes a pair of mating bevel gears 92 and 94. The bevel gear 94 is mounted in the housing 20 for rotations about the drive axis 34 by a ball bearing 96. The bevel gear 94 includes a cylindrical through bore 98 (best seen in FIG. 3) centered on the drive axis 34 and sized to closely receive a cylindrical end portion 100 of the input shaft 40 (best seen in FIGS. 4 and 5) to provide a rotational mount for one end of the input shaft 40. A pair of keys 102 are received in key ways 104 and 106 formed in the bore 98 and the end portion 100, respectively, to prevent rotation of the bevel gear 94 relative to the input shaft 40 and to transfer drive torque from the bevel gear 94 to the input shaft 40. The gear train 36 further includes a planetary gear unit 110 having an output shaft 112 that mounts the bevel gear 92 for rotation about the motor axis 30 and transfers a drive torque to the bevel gear 92 from the planetary gear unit 110 via a key 114 mounted in keyways formed in the bevel gear 92 and the output shaft 112, respectively. The planetary gear unit 110 includes a housing 120, a planet gear carrier 122 that includes the output shaft 112 as an integral part thereof, a ring gear 123 fixed to the housing 120, planet gears 124 meshed with the ring gear 123 and mounted to the plant gear carrier 122 by bushing pins 126, a sun gear 128 that meshes with the planet gears 124 to transfer the drive torque from the output shaft 28 of the motor 26, and ball bearings 130 and 132 that mount the planet gear carrier 122 for rotation relative to the housings 20 and 120 about the motor axis 30. The sun gear 128 includes an input shaft 134 that receives the output shaft 28 and that is locked fixed thereto by a set screw that is received in a transverse, threaded opening in the shaft 134 and engaged against a flat formed on the output shaft 28. The housing 120 is fixed to the housing 20 by a plurality of threaded fasteners 142.

Figure 12:
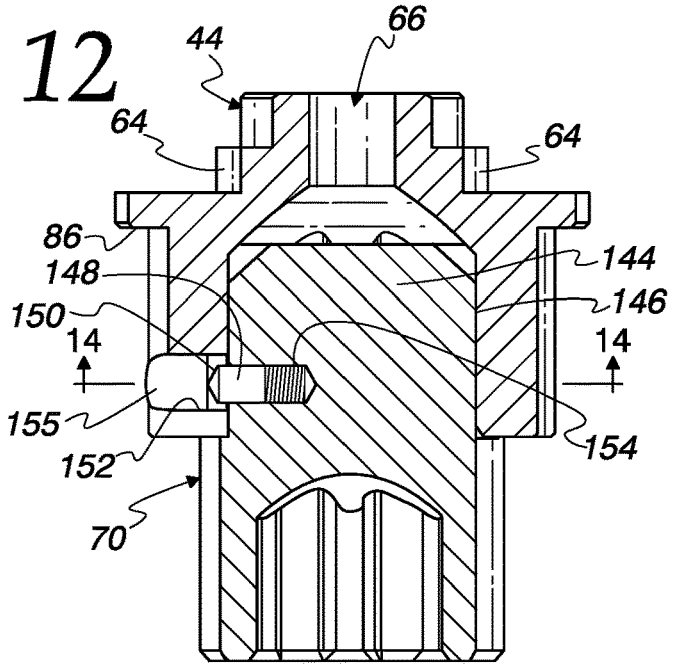
FIG. 12 is a rotated section view taken along line 12-12 in FIG. 10.
Figure 13:
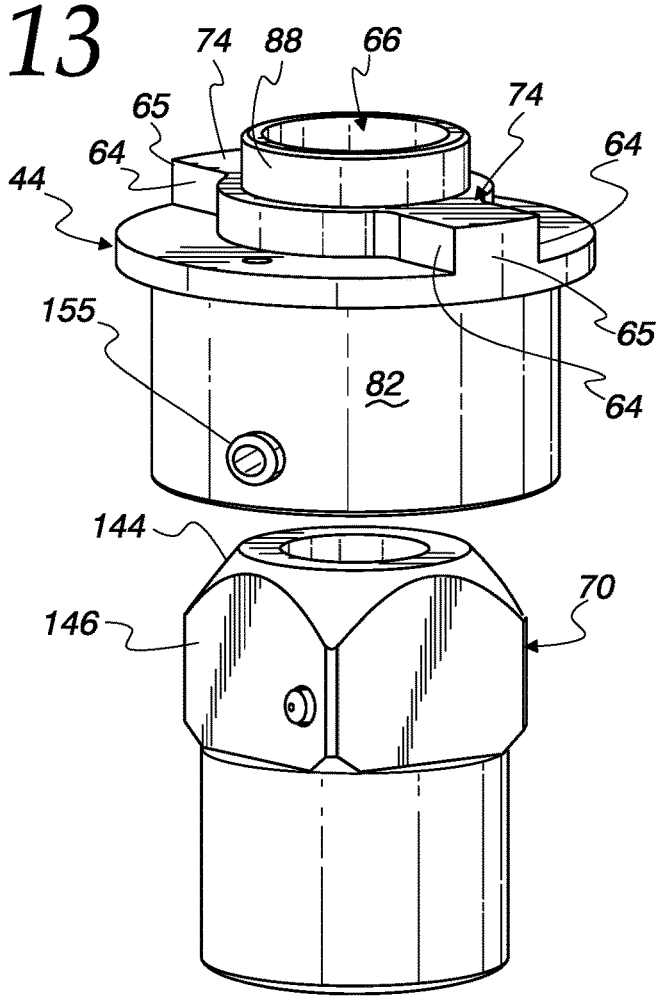
FIG. 13 is an exploded view of the components of FIG. 9.
Figure 16:
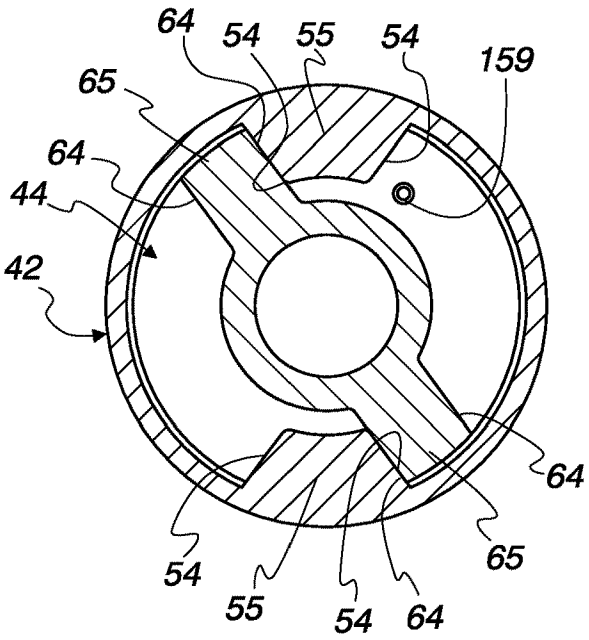
FIG. 16 is a view taken from line 16-16 in FIG. 2.
Figure 15:
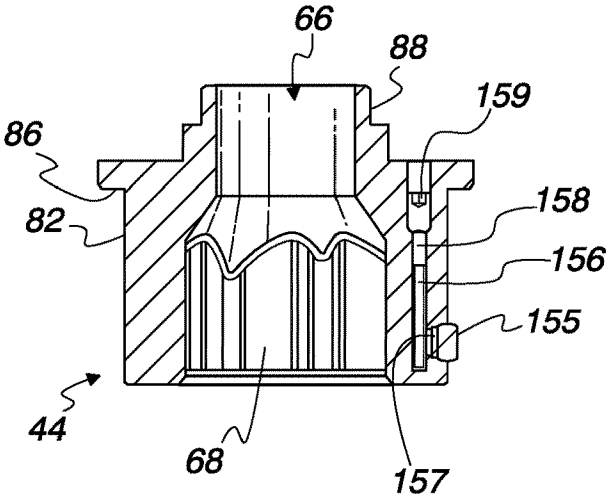
FIG. 15 is a rotated section view taken along line 15-15 in FIG. 10, but only showing the rotatable anvil component.
Figure 14:
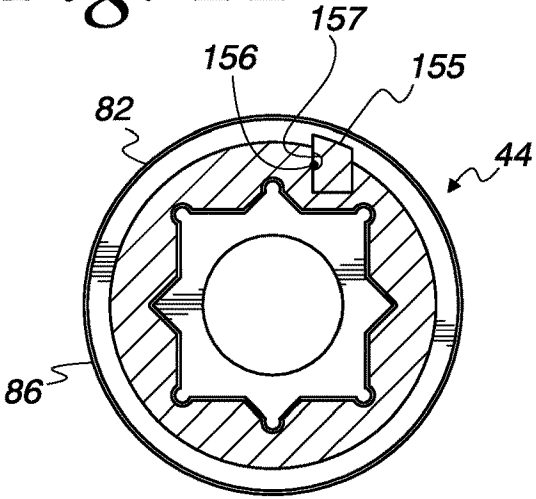
FIG. 14 is a section view taken along line 14-14 in FIG. 12, but only showing the rotatable anvil component.

As best seen in FIGS. 9-13, the impact wrench 10 can include the fastener drive socket 70 having an end portion 144 configured for releasable engagement with the drive features 68 of the rotatable anvil 44. In the illustrated embodiment the end portion 144 is provided in the form of a square drive 146. As best seen in FIG. 12, the socket 70 includes a spring-loaded cylindrical detent 148 having conical shaped end 150 that engages in a bore 152 formed in the rotatable anvil 44 to positively retain the socket 70 in the rotatable anvil. A spring 154 biases the detent 148 into the bore 152, and the rotatable anvil 44 includes a user actuated release button 155 slidably received in the bore 152 that can be pressed by a user to force the detent 148 out of the bore 152 to allow a user to remove the socket 70 from the rotatable anvil 44. As best seen in FIGS. 14 and 15, a spring pin 156 can be received in a relief 157 formed in the cylindrical outer surface of the button 155 to retain the button 155 in the bore 152. As best seen in FIG. 15, the spring pin 156 is received in a bore 158 formed in the rotatable anvil 44, with a set screw 159 being used to prevent the spring pin 156 from exiting the bore 158 during use.

In the illustrated embodiment, the impact wrench 10 includes an electronic motor controller 160 mounted in the housing 20 and operably coupled to the variable trigger switch 26 to control the rotational speed of the motor 28 in response to a user compressing the switch 26, typically with the user's index finger while the user's hand grasps the grip 22 formed on the housing 20. The wrench 10 of the illustrated embodiment also includes a rechargeable battery 162, shown in FIG. 1, that is releasably connected to the housing 20 and operably coupled to the motor 28 and the motor controller 160 via a terminal block 164, shown in FIG. 3, and suitable wiring carried in the housing 20.

The housing 20 of the illustrated embodiment is a multi-piece assembly that includes two main housing halves 170 and 172, a bell housing 174, and an end cap 176, all of which are fixed together with suitable threaded fasteners 178. The housing 20 can be of any suitable material, and in the illustrated embodiment, the halves are made from a suitable injection molded polymer and the bell housing 174 and end cap are made from a suitable metal material.

Preferred embodiments of the inventive concepts are described herein, including the best mode known to the inventor(s) for carrying out the inventive concepts. Variations of those preferred embodiments will become apparent to those of ordinary skill in the art upon reading the foregoing description. The inventor(s) expect skilled artisans to employ such variations as appropriate, and the inventor(s) intend that the inventive concepts can be practiced otherwise than as specifically described herein. Accordingly, the inventive concepts disclosed herein include all modifications and equivalents of the subject matter recited in the claims appended hereto as permitted by applicable law. Moreover, any combination of the above-described elements and features in all possible variations thereof is encompassed by the inventive concepts unless otherwise indicated herein or otherwise clearly contradicted by context. Further in this regard, while highly preferred forms of the angled impact wrench 10 are shown in the figures, it should be understood that this disclosure anticipates variations in the specific details of each of the disclosed components and features of the angled impact wrench 10 and that no limitation to a specific form, configuration, or detail is intended unless expressly and specifically recited in an appended claim.

For example, while specific and preferred forms have been shown for the orientation of the grip 22 on the housing 20, in some applications it may be desirable for the grip 22 to have a different orientation or configuration. As another example, while a specific form and construction has been shown for the housing 20, other suitable forms and constructions can be used. As another example, while a specific configuration has been shown for the gear train 38, in some applications other configurations of gear trains may be used, or other types of operable connections can be used to transfer the drive torque from the motor 26 to the impact drive unit 32, including for example, a belt or chain drive.

As yet another example, while specific configurations have been shown for the components of the impact drive unit 32, other configurations and/or components may be desirable in some applications. For example, while a helical compression spring 39 made of a suitable spring steel is preferred, in some applications other types and/or configurations may be desirable, such as wave springs, and any suitable spring made of any suitable material may be used. As another example, while the annular washers 76 and 78 are preferred to reduce the rotational friction between the spring 39 and the rotatable hammer 42, other means for reducing the rotational friction, including, for example, ball bearings received in an annular groove, such as the groove 180 shown in FIG. 2, underlying the washers 76 and 78 to further reduce the rotational friction. As another example, while the illustrated ball ramps are preferred for the cam features 48 and 56, in some applications it may be desirable to utilize other types/configurations of cam features, including cam features that do not utilize ball bearings. As yet another example, while it is preferred that the rotatable hammer 42 and anvil 44 each include two impact surfaces 54 and 64, respectively, in some applications it may be desirable for the rotatable hammer 42 and anvil 44 to include less than or more than two impact surfaces. As a further example, while each of the components 40, 42, and 44 have been illustrated as one-piece, unitary constructions (i.e., formed from a single piece of material), in some applications it may be desirable for one or more of the components 40, 42, 44 to me a multiple component assembly or fabrication. As another example, while the drive features 68 have been shown in the form of a double square socket, in some applications it may be desirable for the drive features 68 to have other configurations, such as, for example, a hexagonal drive socket, a single square socket, a star socket, and/or a male drive of any suitable configuration.

As further examples, while the variable speed trigger switch 24 is preferred, in some applications it may be desirable for a different type of switch to be used, including, for example, a non-variable speed trigger switch or an on/off toggle switch, and any suitable switch, many of which are known, can be use. As another example, while a brushless, radial flux, electric motor 26 is preferred, in some applications other types of electric motors may be desirable and any suitable electric motor, many of which are known, can be used. In another example, while it is preferred that the angled impact wrench 10 be powered by any suitable removable, rechargeable battery 162, many of which are known, in some applications it may be desirable for the wrench 10 to be powered by non-rechargeable and/or non-removable batteries, or to be powered by an electric cord that can be connected to a power outlet. As another example, while keys 102 and 114 are disclosed herein for the purpose of forming an anti-rotation connection between selected components, any suitable anti-rotation could be used, such as, for example, a toothed spline connection, such as the toothed spline 180 shown as an alternate configuration on the output shaft 28 of the motor 26 in FIG. 3.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. The use of any and all examples, or exemplary language (e.g., "such as") provided herein, is intended merely to better illuminate the inventive concepts disclosed herein and does not pose a limitation on the scope of any invention unless expressly claimed. No language in the specification should be construed as indicating any non-claimed element as essential to the practice of the inventive concepts disclosed herein.

All references, including publications, patent applications, and patents, cited herein are hereby incorporated by reference to the same extent as if each reference were individually and specifically indicated to be incorporated by reference and were set forth in its entirety herein.

What is claimed is:

1. An angled impact wrench capable of driving a fastener onto a workpiece that extends completely through a portion of the impact wrench, the impact wrench comprising:

a housing;

a motor mounted in the housing, the motor having an output shaft rotatable about a first axis; and an impact drive unit mounted in the housing for rotation about a second axis that is nonparallel to the first axis, the impact drive unit having an energy storing condition and an energy release condition, the impact drive unit configured to repeatedly cycle between the energy storing condition and the energy release condition in response to a drive torque supplied by the motor via the output shaft, the impact drive unit comprising:

an input shaft mounted in the housing for rotation about the second axis and operably connected to the output shaft to be rotationally driven about the second axis by the motor, the input shaft having:

a through bore centered on the second axis to allow a workpiece to extend completely through the impact wrench along the second axis, and a cam feature on an outer surface of the input shaft;

a rotatable hammer mounted in the housing for rotation about the second axis and having:

a through bore centered on the second axis and surrounding a portion of the input shaft, a cam feature on an inner surface of the through bore of the rotatable hammer and operably connected to the cam feature on the input shaft to translate the rotatable hammer along the second axis relative to the input shaft over a limited linear distance in response to rotation of the input shaft with the impact drive unit in the energy storing condition, and at least one impact surface;

a compression spring sandwiched between a surface on the input shaft and a surface on the rotatable hammer to store energy as the rotatable hammer translates over the limited linear distance with the impact drive unit in the energy storing condition and to transfer energy back to the rotatable hammer with the impact drive unit in the energy release condition; and a rotatable anvil mounted in the housing for rotation about the second axis and having a through bore centered on the second axis to allow a work piece to extend completely through the impact wrench along the second axis, the through bore of the rotatable anvil including a drive feature to transfer a drive torque to a driven component received in the through bore of the rotatable anvil, and at least one impact surface engageable with the at least one impact surface of the rotatable hammer to receive an impact force from the rotatable hammer with the impact device in the energy release condition.

2. The angled impact wrench of claim 1 further comprising a gear train operably connecting the output shaft of the motor to the input shaft of the impact drive unit.

3. The angled impact wrench of claim 2 wherein the gear train comprises:

a first bevel gear mounted in the housing for rotation about the first axis and operably connected to the output shaft to be rotationally driven by the motor; and a second bevel gear mounted in the housing for rotation about the second axis, the second bevel gear meshed with the first bevel gear to be rotationally driven by the motor, the second bevel gear surrounding a portion of the input shaft.

4. The angled impact wrench of claim 3 wherein the gear train further comprises a planetary gear train comprising a sun gear driven by the output shaft of the motor and a planet gear carrier driving the first bevel gear, the sun gear and the planet gear carrier mounted for rotation about the first axis.

5. The angled impact wrench of claim 1 wherein:

the at least one impact surface of the rotatable hammer comprises a first pair of circumferentially spaced surfaces, and the at least one impact surface of the rotatable hammer comprises a second pair of circumferentially spaced surfaces.

6. The angled impact wrench of claim 1 wherein:

the cam feature on the input shaft is formed in a radially outwardly facing cylindrical surface of the input shaft; and the cam feature on the rotatable anvil is formed in a radially inwardly facing cylindrical surface of the anvil.

7. The angled impact wrench of claim 6 wherein the cam features are ball ramps connected by at least one ball bearing riding in the ball ramps.

8. The angled impact wrench of claim 1 wherein the through bore of the rotatable hammer comprises a radially inwardly facing cylindrical surface that is sized for guided translation over a radially outwardly facing cylindrical surface on the input shaft.

9. The angled impact wrench of claim 1 wherein the through bore in the input shaft comprises a radially inwardly facing cylindrical bearing surface that receives a radially outwardly facing cylindrical journal surface on the rotatable anvil to form a rotatable bearing support for the input shaft.

10. The angled impact wrench of claim 1 further comprising a driven component in the form of a fastener drive socket engaged in the through bore of the rotatable anvil.

11. The angled impact wrench of claim 1 wherein the motor is an electric motor.

12. The angled impact wrench of claim 11 further comprising a battery releasably connected to the housing and operably connected to the electric motor to supply electric power to the electric motor, and wherein the first axis is perpendicular to the second axis.

13. An angled impact wrench capable of driving a fastener onto a workpiece that extends completely through a portion of the impact wrench, the impact wrench comprising:

a housing;

a motor mounted in the housing, the motor having an output shaft rotatable about a first axis;

and an impact drive unit mounted in the housing for rotation about a second axis that is nonparallel to the first axis, the impact drive unit having an energy storing condition and an energy release condition, the impact drive unit configured to repeatedly cycle between the energy storing condition and the energy release condition in response to a drive torque supplied by the motor via the output shaft, the impact drive unit having a through passage extending along the second axis to allow a workpiece to extend completely through the impact wrench;

the impact drive unit comprises a rotatable hammer and a rotatable anvil mounted in the housing to rotation about the second axis, the rotatable hammer impacting the rotatable anvil with the impact drive unit in the energy release condition to create a drive torque at an output of the impact drive unit;

wherein the rotatable hammer has a through bore extending along the second axis, and the rotatable anvil has a through bore extending along the second axis, the through bores defining a portion of the through passage.

14. The angled impact wrench of claim 13 further comprising a gear train mounted in the housing to transfer a drive torque from the output shaft of the motor to the impact drive unit.

15. The angled impact wrench of claim 14 wherein the gear train comprises:

a first bevel gear mounted in the housing for rotation about the first axis and operably connected to the output shaft to be rotationally driven by the motor; and a second bevel gear mounted in the housing for rotation about the second axis, the second bevel gear meshed with the first bevel gear to rotationally driven by the motor, the second bevel gear surrounding a portion of the impact drive unit.

16. The angled impact wrench of claim 15 wherein the gear train further comprises a planetary gear train comprising a sun gear driven by the output shaft of the motor and a planet gear carrier driving the first bevel gear, the sun gear and the planet gear carrier mounted for rotation about the first axis.

17. The angled impact wrench of claim 13 wherein the impact drive unit comprises a spring mounted to store energy with the impact drive unit in the energy storing condition and to release energy with the impact drive unit in the energy release condition.

18. The angled impact wrench of claim 17 wherein the impact drive unit further comprises mating ball ramps configured to generate an axial compression force with the impact drive unit in the energy storing condition.

* * * * *